US008574000B1

(12) United States Patent
Smith

(10) Patent No.: US 8,574,000 B1
(45) Date of Patent: Nov. 5, 2013

(54) NETWORK CABLE ASSEMBLY AND PROTECTIVE SLEEVE THEREOF

(75) Inventor: John Smith, Piscataway, NJ (US)

(73) Assignee: Quality Computer Accessories Inc., Piscataway, NJ (US)

( * ) Notice: Subject to any disclaimer, the term of this patent is extended or adjusted under 35 U.S.C. 154(b) by 0 days.

(21) Appl. No.: 13/455,252

(22) Filed: Apr. 25, 2012

(51) Int. Cl.
*H01R 13/58* (2006.01)

(52) U.S. Cl.
USPC ..... 439/467; 439/447

(58) Field of Classification Search
USPC ..... 439/587, 354, 465, 467, 470, 447
See application file for complete search history.

(56) References Cited

U.S. PATENT DOCUMENTS 4,634,208 A * 1/1987 Hall et al. ..... 439/607.51
6,080,001 A 6/2000 Wong
7,540,667 B2 6/2009 Murano
2003/0100215 A1* 5/2003 Bachman ..... 439/462
2009/0269973 A1* 10/2009 Caveney et al. ..... 439/460
2010/0015844 A1* 1/2010 De Dios Martin et al. ... 439/395

* cited by examiner

*Primary Examiner* — Neil Abrams
*Assistant Examiner* — Travis Chambers
(74) *Attorney, Agent, or Firm* — Bacon & Thomas, PLLC

(57) ABSTRACT

A protective sleeve disposed around a cable and a connector which are connected includes a cable sleeve and a plurality of resilient elements. The cable sleeve includes a bushing, a first ring, and a second ring. The front of the bushing is connected to the connector. The first ring and the second ring are disposed around the cable. The resilient elements are formed by extending the second ring and spaced apart from each other to form an opening for penetration by the cable. The caliber of the opening is less than the caliber of the second ring. Accordingly, the resilient elements are conducive to the positioning of the cable while the cable is penetrating the rings.

11 Claims, 9 Drawing Sheets

NETWORK CABLE ASSEMBLY AND PROTECTIVE SLEEVE THEREOF

BACKGROUND OF THE INVENTION

1. Field of the Invention

The present invention relates to protective sleeves for electrical connectors, and more particularly, to a protective sleeve applicable to an electrical connector for a network cable.

2. Description of the Related Art

A conventional network cable comprises a cable which is usually a multi-core structure, and a process of manufacturing a network cable locking device entails engaging the cable and a connector of a network by means of a specific engaging tool, wherein the point of connection of the connector and the cable is usually protected by a protective sleeve. For instance, U.S. Pat. No. 7,540,667 and U.S. Pat. No. 6,080,001 disclose protective sleeves of different structures, respectively.

At present, diameter specifications of a network cable abound. Referring to FIG. 9, there is shown a schematic view of a conventional network cable assembly 4. As shown in FIG. 9, the network cable assembly 4 comprises a connector 40, a network cable 41 connected to the connector 40, and a protective sleeve 42 disposed around the connector 40 and the network cable 41. As shown in FIG. 6, the diameter of the network cable 41 is less than that of the end of the protective sleeve 42, and in consequence the network cable 41 is not held in place by the protective sleeve 42. Hence, the network cable 41 is likely to swing relative to the connector 40 and thereby increases the risk of disconnecting the network cable 41 from the connector 40.

SUMMARY OF THE INVENTION

It is a primary objective of the present invention to provide a protective sleeve capable of holding a cable in place efficiently and thereby preventing the cable from swinging.

In order to achieve the above and other objectives, the present invention provides a network cable assembly and a protective sleeve thereof. The network cable assembly comprises a protective sleeve disposed around a cable and a connector which are connected. The protective sleeve comprises a cable sleeve and a plurality of resilient elements. The cable sleeve comprises a bushing, a first ring, and a second ring. The bushing has a front connected to the connector. The first ring is formed by extending the bushing backward and disposed around the cable. The front of the second ring is connected to the first ring. The second ring and the first ring are spaced apart from each other and disposed around the cable. The resilient elements are formed by extending the rear of the second ring backward by a predetermined length. The resilient elements on the second ring are spaced apart from each other and form an opening for penetration by the cable. The caliber of the opening is less than the caliber of the second ring of the protective sleeve.

According to the present invention, the resilient elements tilt and have resilience, and thus the resilient elements abut against the cable resiliently as soon as a cable of a relatively small diameter penetrates the second ring of the protective sleeve. Hence, the protective sleeve of the present invention is applicable to cables of different diameters.

DETAILED DESCRIPTION OF PREFERRED EMBODIMENTS

Figure 1:
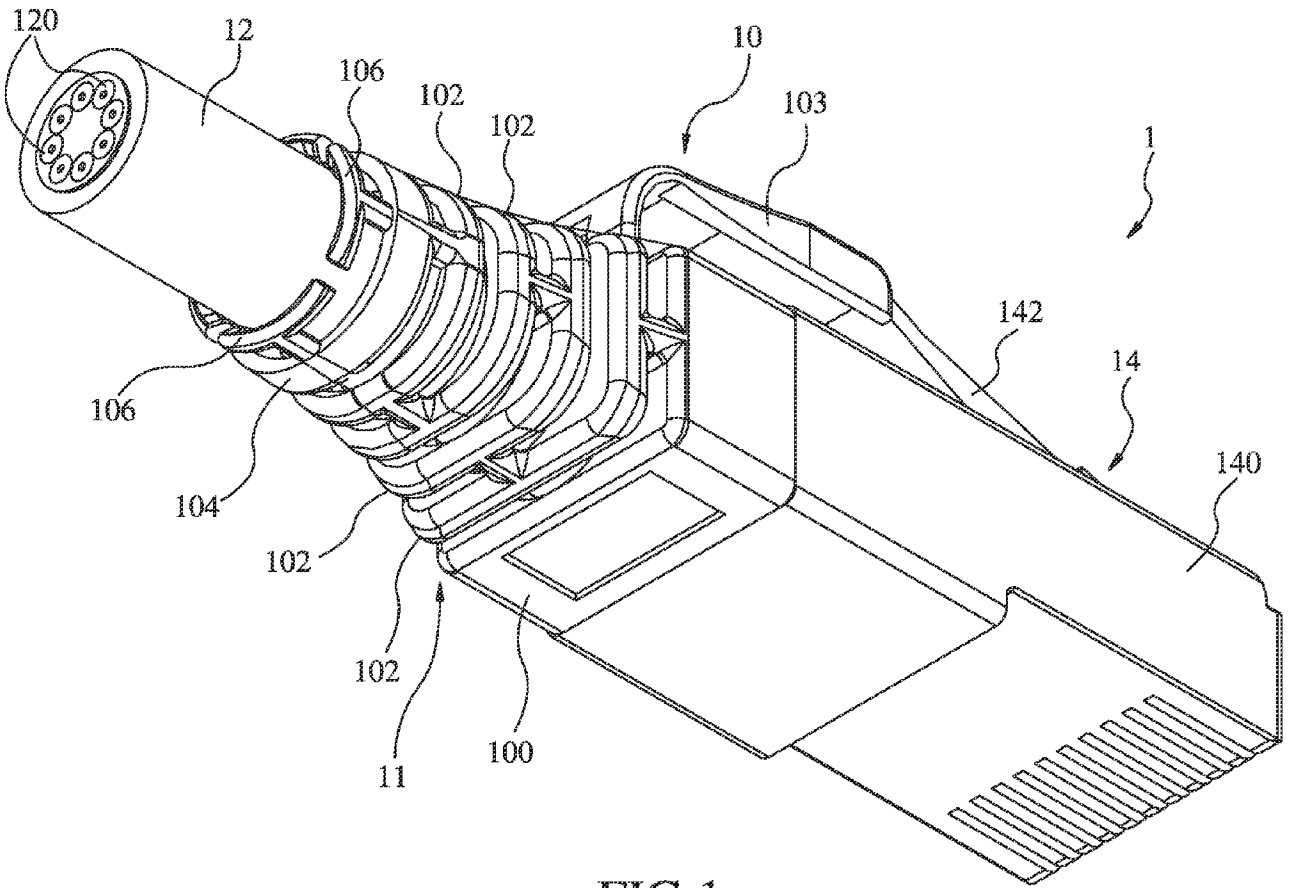
FIG. 1 is a schematic view of a network cable assembly according to the first preferred embodiment of the present invention.

Referring to FIG. 1, there is shown a schematic view of a network cable assembly 1 according to the first preferred embodiment of the present invention. The network cable assembly 1 comprises a protective sleeve 10, a cable 12, and a connector 14. In this embodiment, the cable 12 is a network cable which usually has eight conductors 120, whereas the connector 14 is a RJ45 network cable connector, but the present invention is not limited thereto. The connector 14 has a body 140, an inner casing (not shown), eight pins (not shown), and a pressing plate 142. The inner casing is disposed inside the body 140. The inner casing has eight through holes for penetration by the eight conductors 120 of the cable 12, respectively. The pins are connected to the conductors 120, respectively, spaced apart from each other, and disposed inside the body 140. Each of the pins is partly exposed from the bottom of the body 140. After the eight conductors 120 of the cable 12 have penetrated the eight through holes of the inner casing, respectively, the eight conductors 120 of the network cable and the eight pins inside the body 140 are pressed with a pair of pressing jaws and thus engaged with each other, respectively, such that the pins are connected to the conductors 120.

Figure 2:
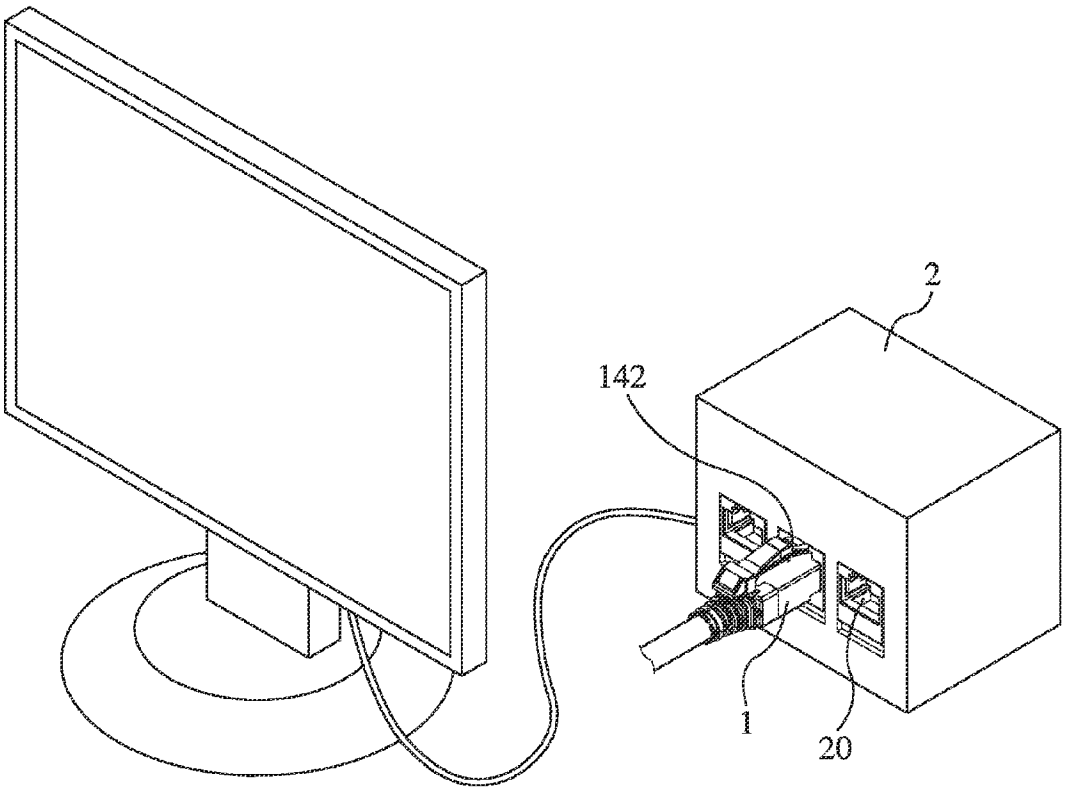
FIG. 2 is a schematic view of the network cable assembly connected to an electronic device.

Referring to FIG. 2, there is shown a schematic view of the network cable assembly 1 (of FIG. 1) connected to an electronic device 2. Each of two terminal ends of the cable 12 has the network cable assembly 1. This embodiment is exemplified by the network cable assembly 1. After the network cable assembly 1 has been inserted into a network jack 20 of the electronic device 2 (such as a computer, a router, or a server), the pins in the network jack 20 are electrically connected to the network cable assembly 1, thereby allowing data to be transmitted by means of the cable 12. Referring to FIG. 1 and FIG. 2, the pressing plate 142 is connected to the top of the body 140. Upon insertion of the network cable assembly 1 into the network jack 20 of the electronic device 2, the front end of the pressing plate 142 is snap-engaged within the network jack 20, such that the network cable assembly 1 cannot be disconnected from the network jack 20. To unplug the network cable assembly 1 from the network jack 20, it is necessary to press the pressing plate 142 and than disconnect the network cable assembly 1 from the network jack 20.

Figure 3:
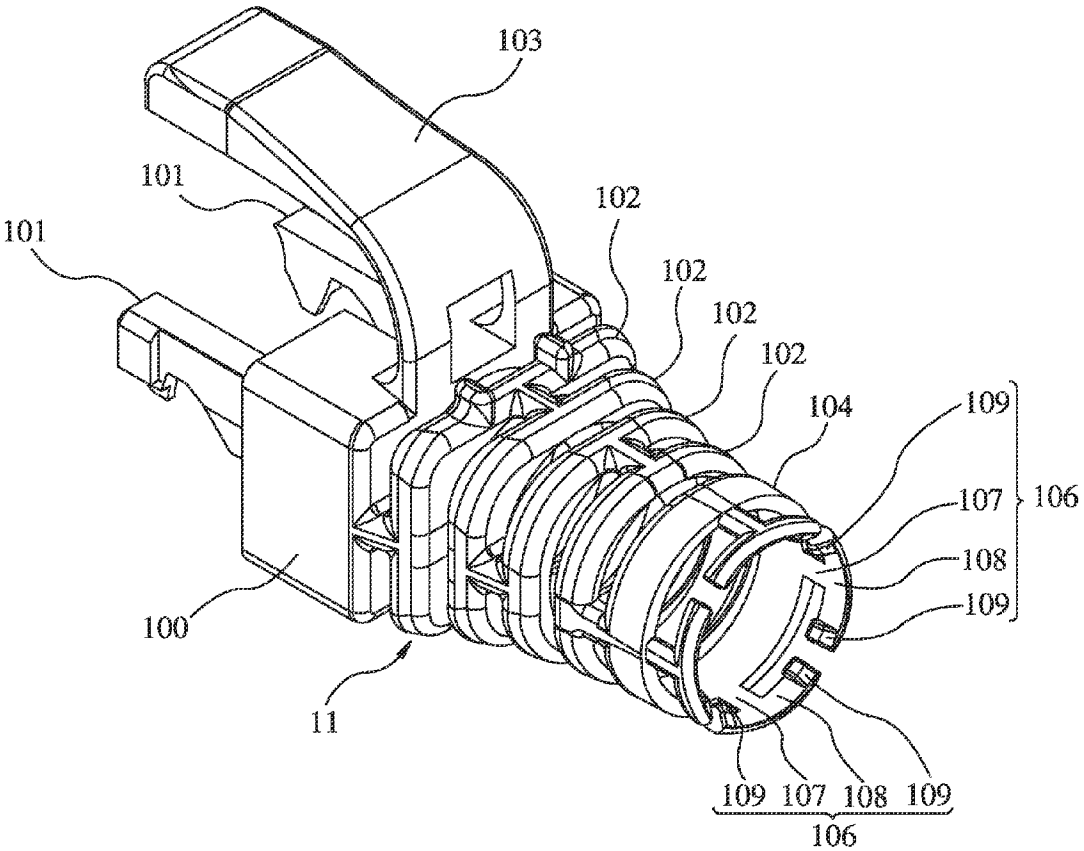
FIG. 3 is a schematic view of a protective sleeve of the network cable assembly.

Referring to FIG. 1 and FIG. 3, FIG. 3 is an enlarged schematic view of the protective sleeve 10 of FIG. 1. The protective sleeve 10 is adapted to be disposed around the network cable assembly 1 (comprising the connector 14 and the cable 12 which are connected), and comprises a cable sleeve 11 and a plurality of resilient elements 106. The cable sleeve 11 comprises a bushing 100, a plurality of first rings 102, and a second ring 104. The front of the bushing 100 is connected to the connector 14. The first rings 102 are formed by extending the bushing 100 backward, and are disposed around the cable 12. In this embodiment, four said first rings 102 are provided. The front of the second ring 104 is connected to the hindmost one of the first rings 102. The second ring 104 and the first rings 102 are spaced apart from each other and disposed around the cable 12. Once the cable 12 starts to be bent, a buffer is formed between the first rings 102 and the second ring 104 to thereby prevent the cable 12 from being overly bent. In practice, it is feasible that only one said first ring 102 is provided; hence, the quantity of the first rings 102 is not limited to the disclosure of present invention as described herein, that is, the plurality of first rings 102.

Figure 4:
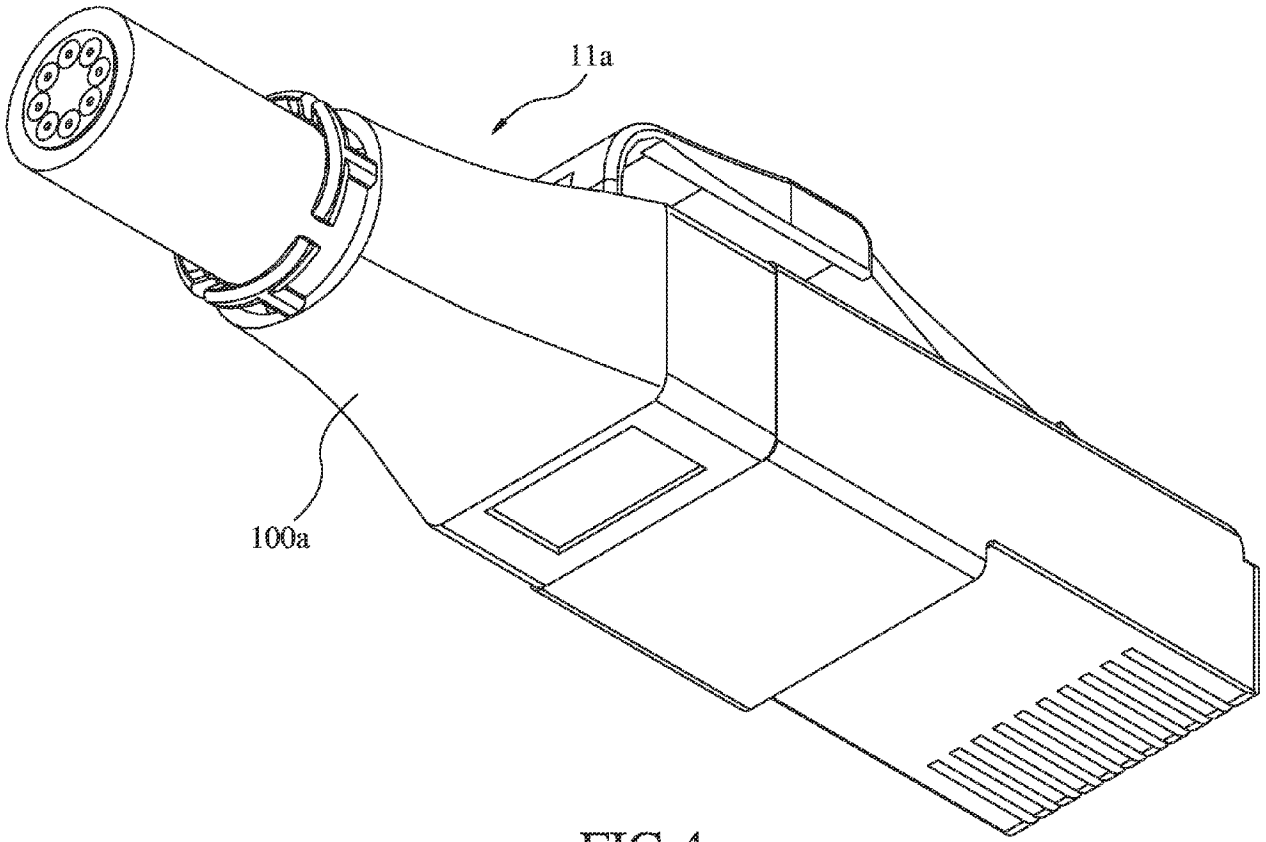
FIG. 4 is a schematic view of a network cable assembly according to the second preferred embodiment of the present invention.

Referring to FIG. 4, compared to the first preferred embodiment, the cable sleeve 11*a* has a front connected to the connector and the cable, and has a front aperture and a rear aperture communicating with each other. The resilient elements formed by extending a rear of the cable sleeve 11*a* backward by a predetermined length. In this embodiment, the cable sleeve 11*a* can be regarded as having only one bushing 100*a*. Preferably, the hushing 100*a* is selectively made of a resilient material, such as rubber, to achieve the aforesaid purpose of preventing the cable from being overly bent.

Referring to FIGS. 1, 3, the resilient elements 106 are formed by extending the rear of the second ring 104 backward by a predetermined length. The resilient elements 106 are spaced apart from each other and form an opening for penetration by the cable 12. The caliber of the opening is less than the caliber of the second ring 104. Since the caliber of the opening formed by the resilient elements 106 is less than the caliber of the second ring 104, the resilient elements 106 are conducive to the positioning of the cable 12 even though the caliber of the cable 12 is slightly less than the caliber of the second ring 104, thereby overcoming the aforesaid drawback of the prior art, that is, the necessity for equal diameters of a network cable and the end of a protective sleeve. Furthermore, the protective sleeve of the present invention can also be applicable to a fixing tube, a flexible hose, or an optical fiber, and thus is not limited to the aforesaid network cable.

The protective sleeve 10 further comprises two engaging hooks 101 and a protective plate 103. The connector 14 has two engaging portions (not shown) therein. The two engaging hooks 101 are connectable to the front of the bushing 100 of the protective sleeve 10, and can be snap-engaged with the two engaging portions of the connector 14, respectively. In practice, the bushing 100 is designed to enclose the connector 14, the two engaging hooks 101 can be dispensed with. The protective plate 103 has one end connected to the bushing 100, and has the other end that covers the pressing plate 142 from above for preventing the pressing plate 142 from being severed.

Each of the resilient elements 106 comprises an arm 107, an arcuate arm 108, and at least two bumps 109. The arm 107 has one end connected to the second ring 104. The arcuate arm 108 is connected to the other end of the arm 107. The arcuate arms 108 together from the opening. The two bumps 109 are disposed at two ends of the arcuate arm 108, respectively, and face the center of the opening. Hence, once the cable 12 of a relatively small diameter penetrates the first rings 102 and the second ring 104, the resilient characteristics of each of the arms 107 will cause the arms 107 to protrude and retract resiliently, depending on the diameter of the cable 12; as a result, the bumps 109 disposed at the two ends of the arcuate arm 108, respectively, abut against the cable 12, and the arcuate arms 108 protrude and retract in accordance with the surface of the cable 12.

Figure 5:
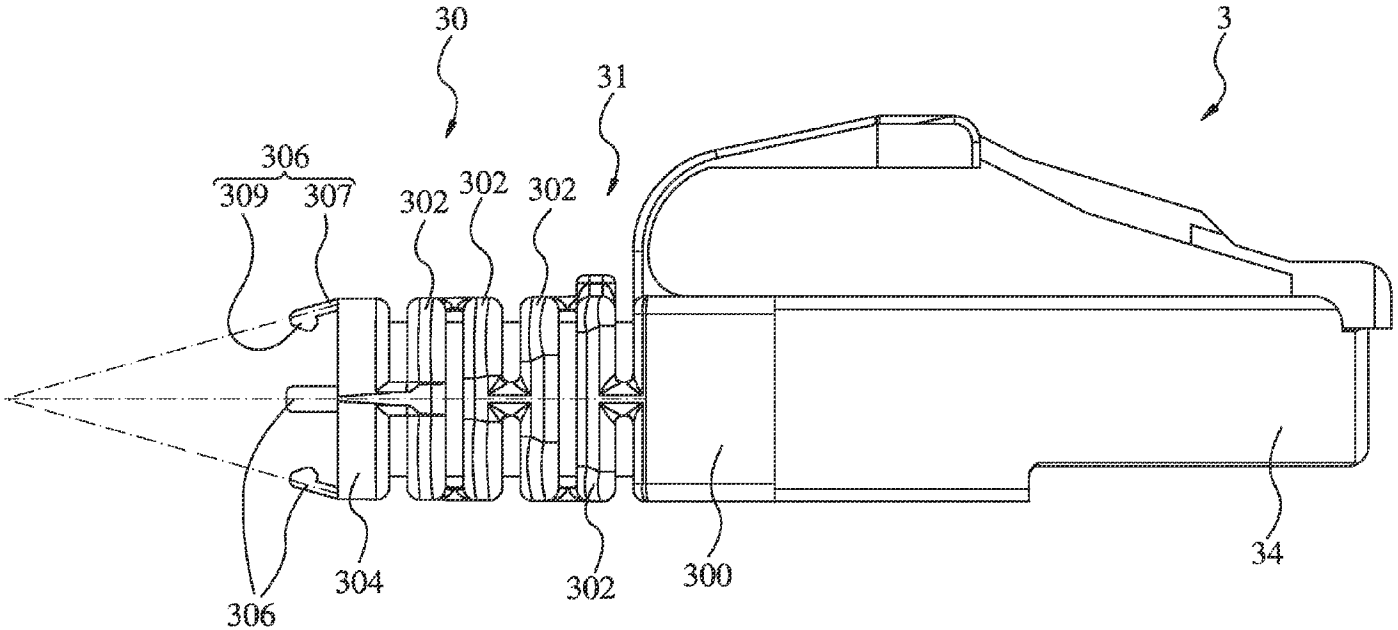
FIG. 5 and FIG. 6 are schematic views of a network cable assembly according to the third preferred embodiment of the present invention.
Figure 6:
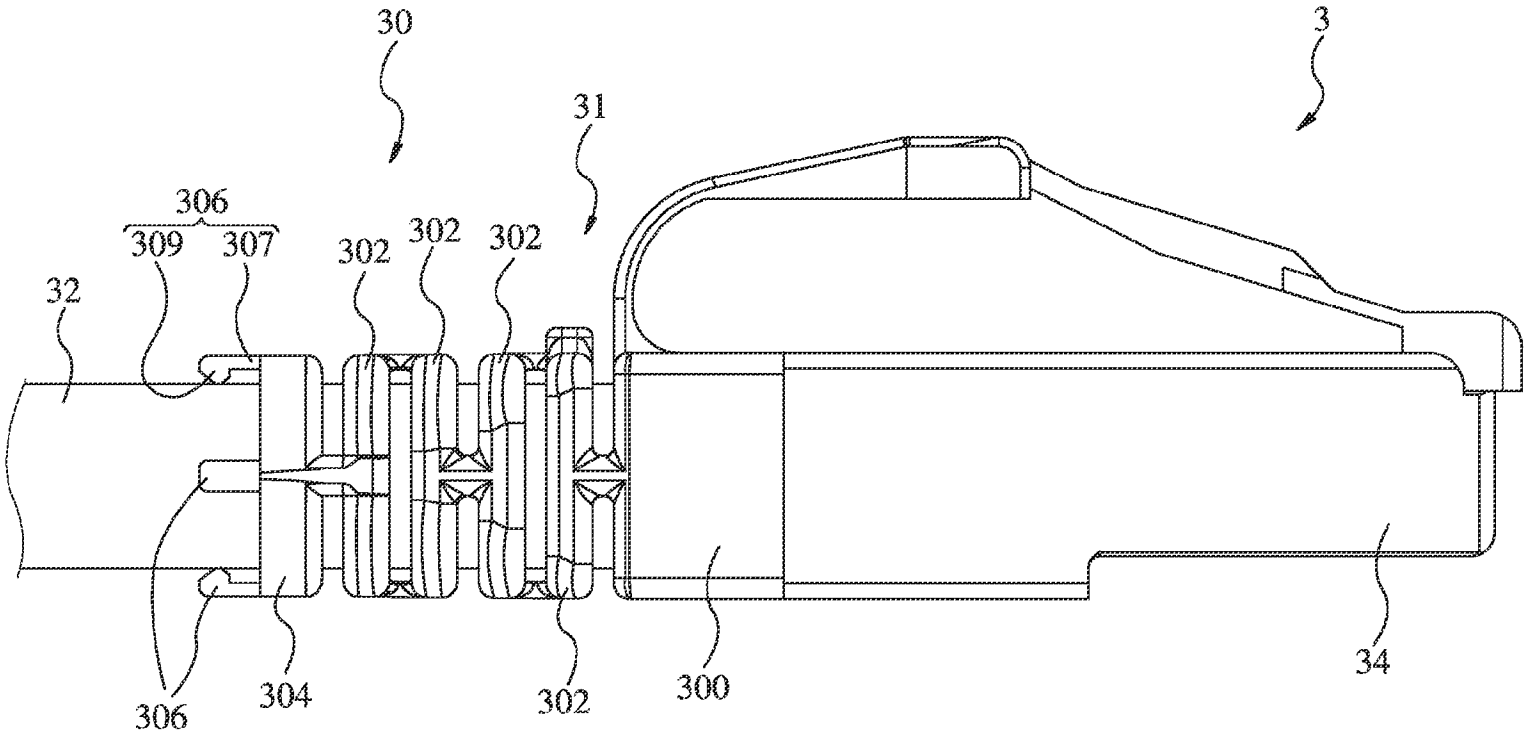

Referring to FIG. 5 and FIG. 6, there are shown schematic views of a network cable assembly 3 according to the third preferred embodiment of the present invention. A cable 32 and a connector 34 of the network cable assembly 3 in the second preferred embodiment are identical to the cable 12 and the connector 14 of the network cable assembly 1 in the first preferred embodiment and thus are not described herein again for the sake of brevity. A protective sleeve 30 of the network cable assembly 3 comprises a cable sleeve 31 and a plurality of resilient elements 306. The cable sleeve 31 comprises a bushing 300, a plurality of first rings 302, and a second ring 304. However, the application and functions of the bushing 300, the first rings 302, and the second ring 304 of the cable sleeve 31 are identical to that of the bushing 100, the first rings 102, and the second ring 104 in the first preferred embodiment and thus are not described herein again for the sake of brevity.

The resilient elements 306 each comprise an arm 307 and a bump 309. The arm 307 has one end connected to the second ring 304 and tilts toward an imagined central axis of the opening so as to accommodate the cable 32 of an even smaller diameter. The bump 309 is disposed at the other end of the arm 307 and faces the center of the opening. Hence, the bump 309 of each of the resilient elements 306 can still abut against the cable efficiently, and the arm 307 protrudes and retracts in accordance with the surface of the cable. Furthermore, it is also feasible that the arms 107 in the first preferred embodiment is capable of tilting in the same manner as the arms 307 are in the second preferred embodiment.

The arms 307 of the resilient elements 306 are disposed at the second ring 304 and spaced apart from each other, such that the bumps 309 can abut against the surface of the cable 32 evenly.

Preferably, the arms 107 in the first preferred embodiment are spaced apart from each other in the same as described above.

Figure 7:
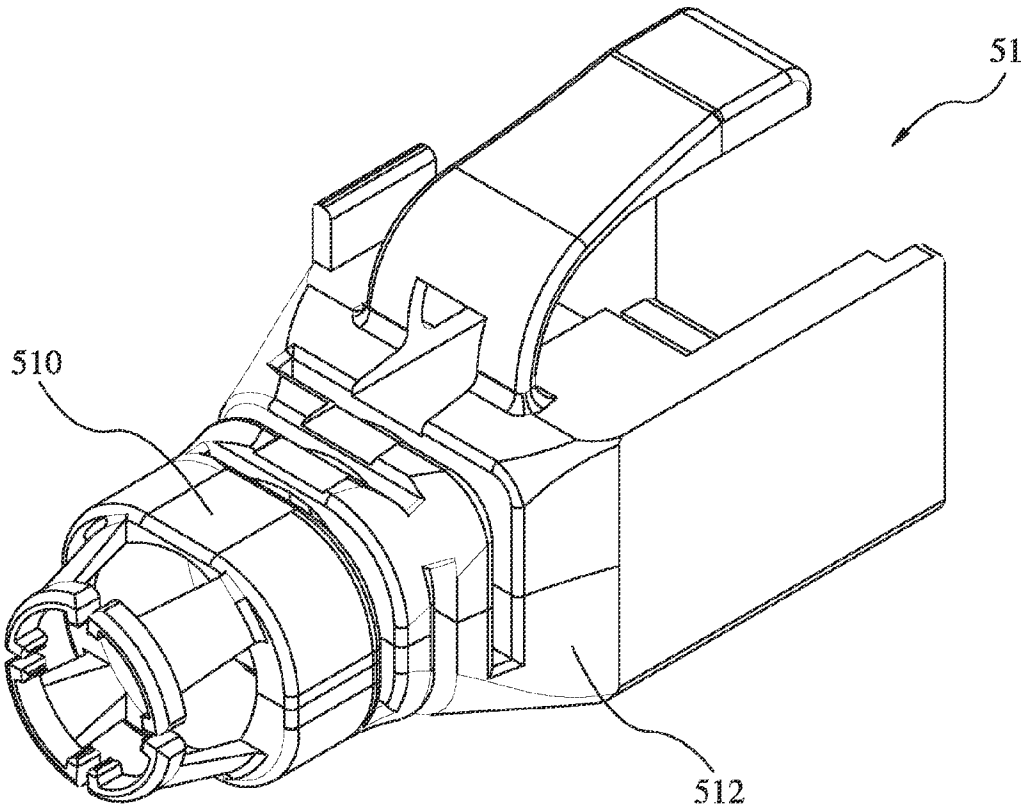
FIG. 7 and FIG. 8 are perspective views of a cable sleeve of a network cable assembly according to the fourth preferred embodiment of the present invention.
Figure 8:
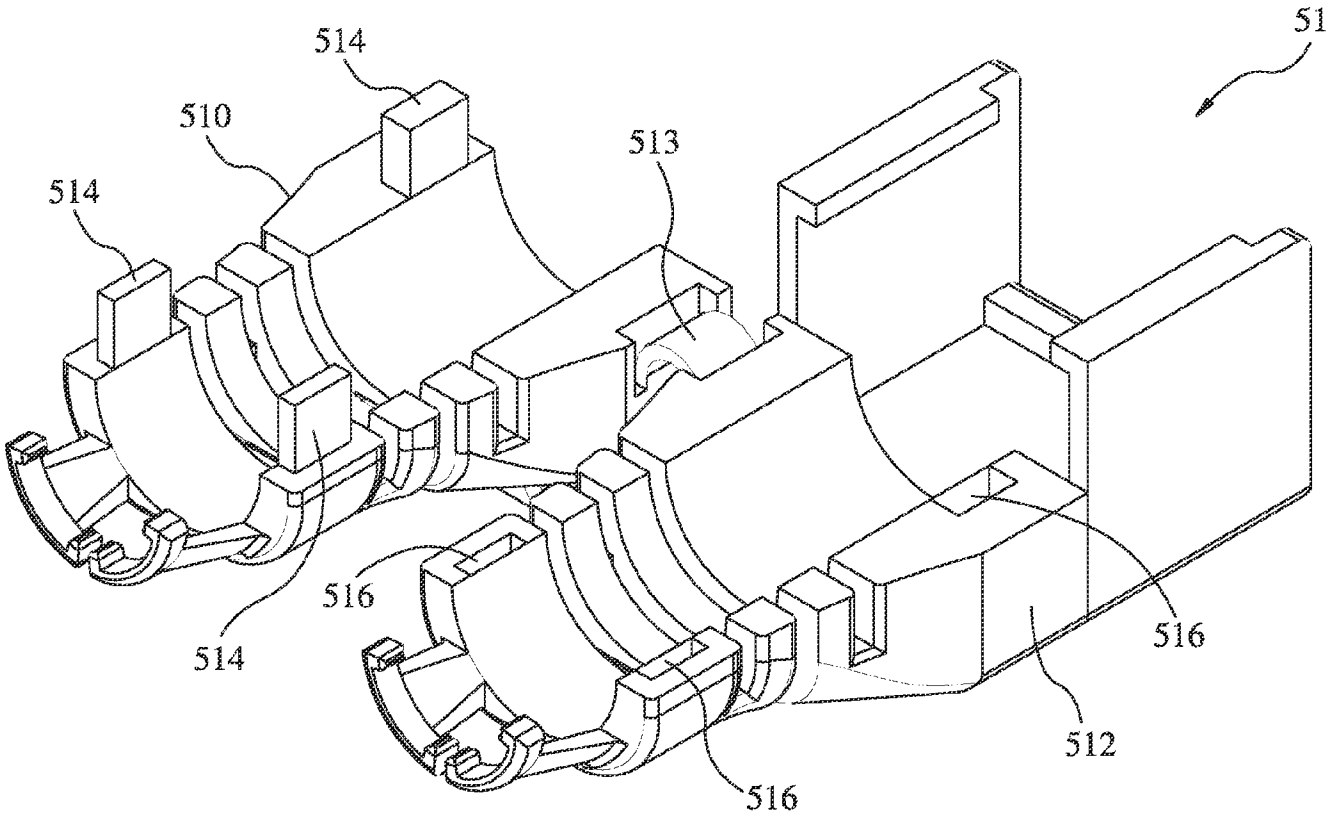
Figure 9:
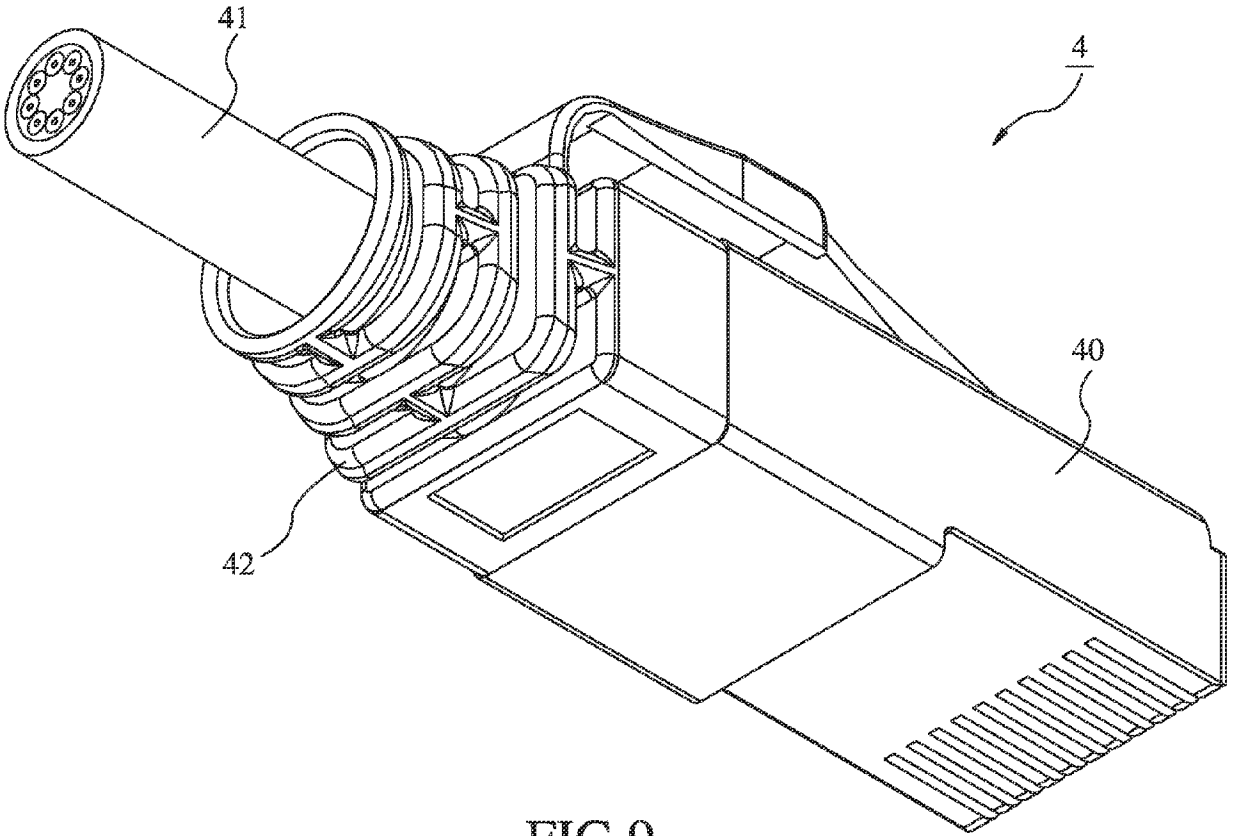
FIG.9 PRIOR ART
FIG. 9 (prior ART) is a schematic view of a conventional network cable assembly.

Referring to FIG. 7 and FIG. 8, there are shown perspective views of a cable sleeve 51 of a network cable assembly according to the fourth preferred embodiment of the present invention. As shown in FIG. 7 and FIG. 8, the network cable assembly is substantially identical to its counterparts in the preceding three preferred embodiments. The network cable assembly in the fourth preferred embodiment is distinguished from its counterparts in the preceding three preferred embodiments by the following technical features. The cable sleeve 51 of the network cable assembly has an upper housing 510 and a lower housing 512 engaged with the upper housing 510. The upper housing 510 and the lower housing 512 are connected by a connection plate 513 therebetween, such that the upper housing 510 and the lower housing 512 can combine with each other. Referring to FIG. 8, the upper housing 510 has a plurality of insertion elements 514, whereas the lower housing 512 has a plurality of insertion holes 516 corresponding in position to the insertion elements 514, respectively. Once the upper housing 510 and the lower housing 512 combine with each other, the insertion elements 514 will be inserted into the insertion holes 516, respectively, in a one-to-one manner. In practice, it is also feasible for the insertion elements 514 to be formed on the lower housing 512 and for the insertion holes 516 to be formed on the upper housing 510. Hence, the positions of the insertion elements 514 and the insertion holes 516 are not limited to the aforesaid preferred embodiment. Furthermore, the cable sleeve need not be disposed around the cable before the electrical connector is installed; hence, the cable sleeve manifests enhanced ease of use.

In conclusion, the protective sleeve of the present invention is applicable to cables of different diameters, so as to overcome the drawbacks of the prior art. The structure of the resilient elements of the present invention is subject to changes in accordance with the above description and thus is not restricted to the aforesaid two preferred embodiments.

What is claimed is:

1. A protective sleeve disposed around a cable and a connector which are connected, the protective sleeve comprising:

a cable sleeve comprising a bushing, a first ring, and a second ring, the bushing having a front connected to the connector; the first ring formed by extending the bushing backward and disposed around the cable; the second ring having a front connected to the first ring, wherein the second ring and the first ring are spaced apart from each other and disposed around the cable; and a plurality of resilient elements formed by extending a rear of the second ring backward by a predetermined length and spaced apart from each other to form an opening for penetration by the cable, wherein a caliber of the opening is less than a caliber of the second ring, each of the resilient elements having an arm and a first bump, the arm having an end connected to the second ring and tilting toward an imagined central axis of the opening, the first bump being disposed at another end of the arm and facing a center of the opening, the first bumps of the resilient elements abutting against the cable while the cable penetrates the first ring and the second ring.

2. The protective sleeve as defined in claim 1, wherein the resilient elements each further comprise an arcuate arm, and a second bump, the arcuate arm being connected to another end of the arm and positioned at a mouth edge of the opening, and the first bumps and the second bump being disposed at two ends of the arcuate arm, respectively, and facing a center of the opening, wherein the first bumps and the second bumps abut against the cable as soon as the cable penetrates the first ring and the second ring.

3. The protective sleeve as defined in claim 2, wherein the arms of the resilient elements are spaced apart from each other.

4. A protective sleeve disposed around a cable and a connector which are connected, the protective sleeve comprising:

a cable sleeve having a front connected to the connector and the cable, and having a front aperture and a rear aperture communicating with each other; and a plurality of resilient elements formed by extending a rear of the cable sleeve backward by a predetermined length and spaced apart from each other to form an opening for penetration by the cable, wherein a caliber of the opening is less than a caliber of the rear aperture of the cable sleeve, each of the resilient elements having an arm and a first bump, the arm having an end connected to the second ring and tilting toward an imagined central axis of the opening, the bump being disposed at another end of the arm and facing a center of the opening, the first bumps of the resilient elements abutting against the cable while the cable penetrates the first ring and the second ring.

5. The protective sleeve as defined in claim 4, wherein the cable sleeve comprises a bushing, a first ring, and a second ring, the first ring being formed by extending backward from the bushing, the second ring having a front connected to the first ring, wherein the second ring and the first ring are spaced apart from each other, wherein a caliber of the rear aperture of the cable sleeve is equal to a caliber of the second ring.

6. The protective sleeve as defined in claim 4, wherein the resilient elements each further comprise an arcuate arm, and a second bump, the arcuate arm being connected to another end of the arm and positioned at a mouth edge of the opening, and the first bump and the second bump being disposed at two ends of the arcuate arm, respectively, and facing a center of the opening, the first bumps and the second bumps abutting against the cable while the cable penetrates the first ring and the second ring.

7. The protective sleeve as defined in claim 4, wherein the arms of the resilient elements are spaced apart from each other.

8. The protective sleeve as defined in claim 4, wherein the cable sleeve has an upper housing and a lower housing engaged with the upper housing.

9. A network cable assembly, comprising:

a cable;

a connector connected to the cable;

a protective sleeve, comprising:

a cable sleeve comprises a bushing, a first ring, and a second ring, the bushing having a front connected to the connector; the first ring formed by extending the bushing backward and disposed around the cable; the second ring having a front connected to the first ring, wherein the second ring and the first ring are spaced apart from each other and disposed around the cable; and a plurality of resilient elements formed by extending a rear of the second ring backward by a predetermined length and spaced apart from each other to form an opening for penetration by the cable, wherein a caliber of the opening is less than a caliber of the second ring, the resilient elements having an arm and a first bump, the arm having an end connected to the second ring and tilting toward an imagined central axis of the opening, the first bump being disposed at another end of the arm and facing a center of the opening, the first bumps of the resilient elements abutting against the cable while the cable penetrates the first ring and the second ring.

10. The network cable assembly as defined in claim 9, wherein the resilient elements each further comprise an arcuate arm, and a second bump the arcuate arm being connected to another end of the arm and positioned at a mouth edge of the opening, and the first bump and the second bump being disposed at two ends of the arcuate arm, respectively, and facing a center of the opening, the first bumps and the second bumps abutting against the cable as soon as the cable penetrates the first ring and the second ring.

11. The network cable assembly as defined in claim 9, wherein the arms of the resilient elements are spaced apart from each other.

* * * * *